US008227989B2

(12) United States Patent
Kim

(10) Patent No.: US 8,227,989 B2
(45) Date of Patent: Jul. 24, 2012

(54) DISCHARGE ELEMENT WITH DISCHARGE-CONTROL ELECTRODE AND THE CONTROL CIRCUIT THEREOF

(75) Inventor: Seonho Kim, Daejeon (KR)

(73) Assignee: Surgelab Korea, Daejeon (KR)

( * ) Notice: Subject to any disclaimer, the term of this patent is extended or adjusted under 35 U.S.C. 154(b) by 166 days.

(21) Appl. No.: 12/532,693

(22) PCT Filed: Aug. 28, 2008

(86) PCT No.: PCT/KR2008/005049

§ 371 (c)(1),
(2), (4) Date: Sep. 23, 2009

(87) PCT Pub. No.: WO2009/028881

PCT Pub. Date: Mar. 5, 2009

(65) Prior Publication Data

US 2010/0141166 A1 Jun. 10, 2010

(30) Foreign Application Priority Data

Aug. 28, 2007 (KR) ..... 10-2007-0086390

(51) Int. Cl.
*H01J 61/54* (2006.01)

(52) U.S. Cl. ..... 313/594; 313/234; 313/299; 315/276; 315/307

(58) Field of Classification Search ..... 313/234, 313/299, 534, 594; 315/276, 307
See application file for complete search history.

(56) References Cited

U.S. PATENT DOCUMENTS

| | | | | |
|---|---|---|---|---|
| 3,562,576 | A * | 2/1971 | Rusterholz | 313/299 |
| 5,925,985 | A * | 7/1999 | Zeng et al. | 315/224 |
| 2005/0035700 | A1* | 2/2005 | Yano et al. | 313/234 |
| 2006/0209485 | A1* | 9/2006 | Imai et al. | 361/120 |

FOREIGN PATENT DOCUMENTS

| | | |
|---|---|---|
| JP | 2001-210445 | 8/2001 |
| JP | 2005-63720 | 3/2005 |
| JP | 2006-244794 | 9/2006 |

* cited by examiner

*Primary Examiner* — Douglas W Owens
*Assistant Examiner* — Thai Pham
(74) *Attorney, Agent, or Firm* — Clark & Brody

(57) ABSTRACT

The present invention relates to a new discharge element having a discharge-control electrode for inducing a discharge even at low voltage by improving a characteristic in which a discharge element may not be discharged against a fast transient voltage when it is at low voltage, and more specifically, the discharge element having a discharge-control electrode according to the present invention comprises an airtight cylinder formed with a ceramic insulation material, a pair of discharge electrodes arranged for facing an end opening of the airtight cylinder, a discharge gap formed between the pair of discharge electrodes, a discharge-assisting material filled inside the airtight cylinder, and a discharge-control electrode in contact with the airtight cylinder and physically separated from the discharge-assisting material, wherein a discharge between the pair of discharge electrodes is induced by a control voltage applied through the discharge-control electrode.

10 Claims, 10 Drawing Sheets

【Figure 1】
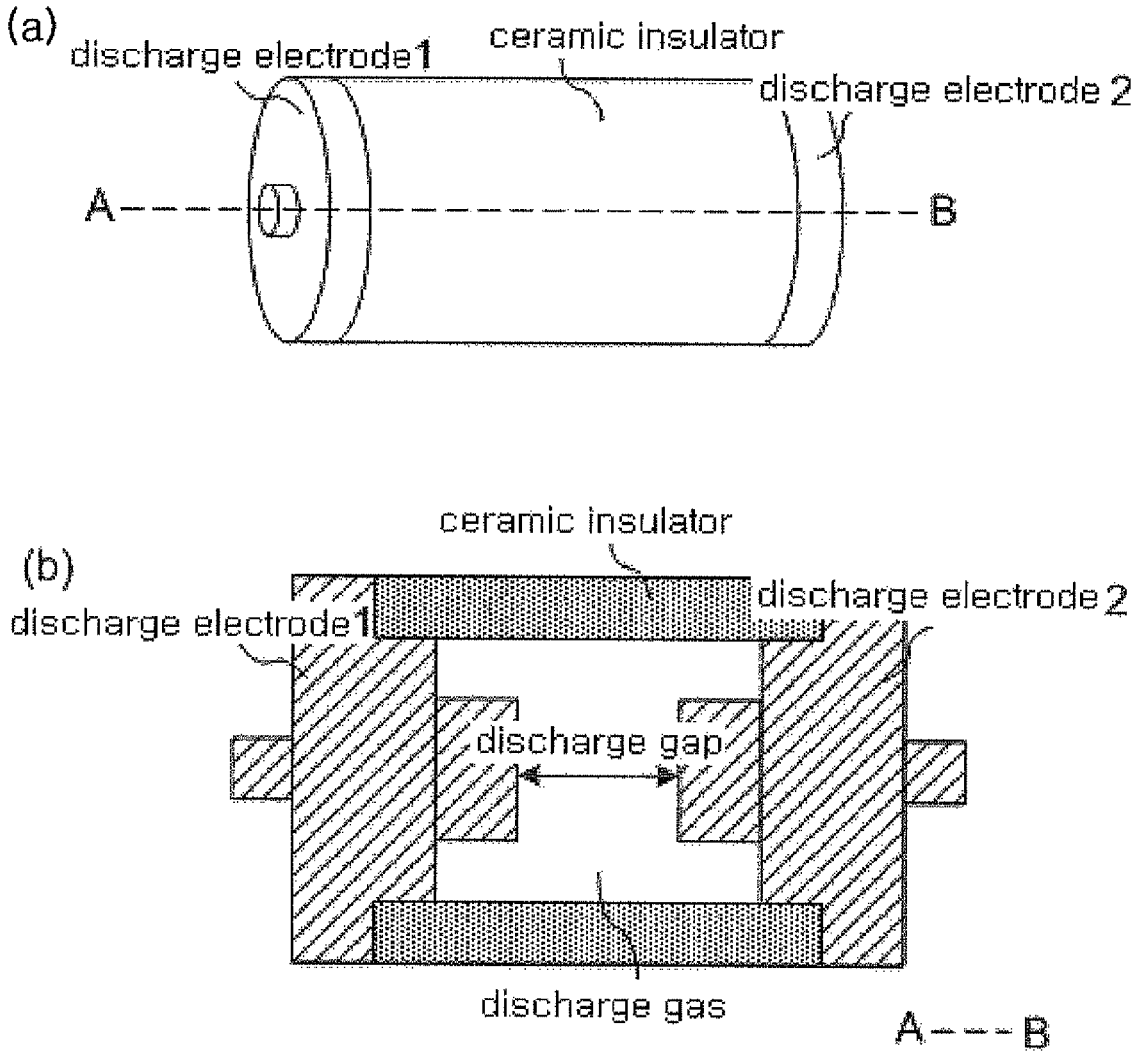
Prior Art

【Figure 2】
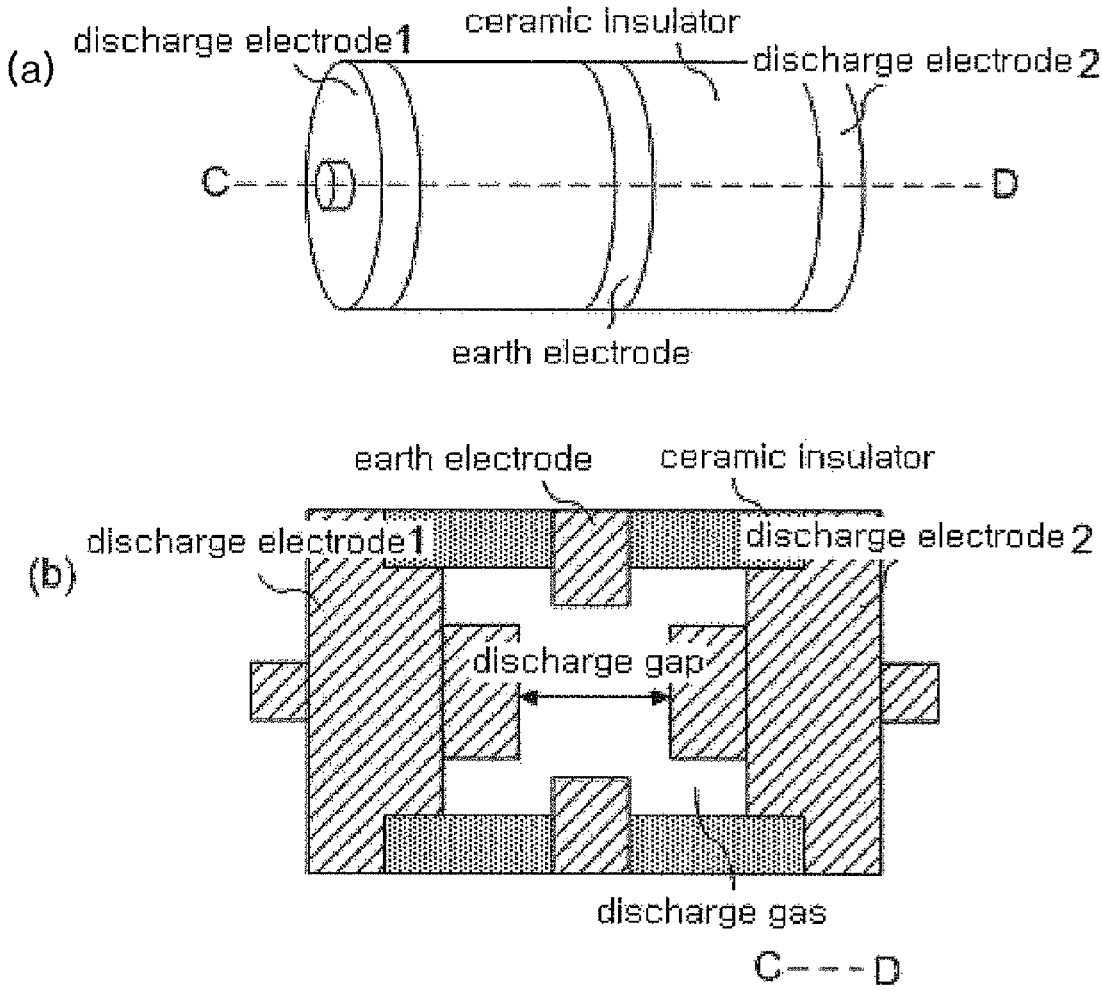
Prior Art

【Figure 3】
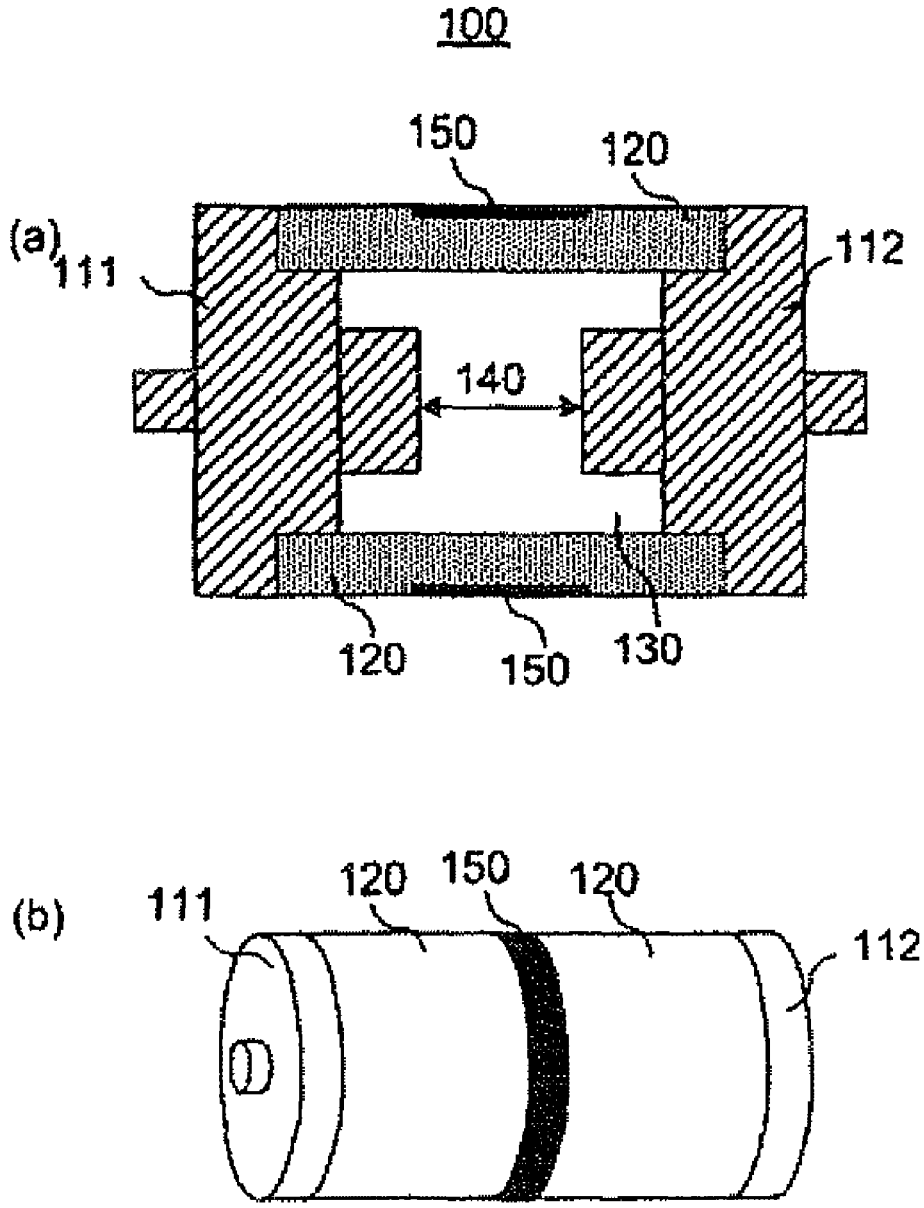

[Figure 4]
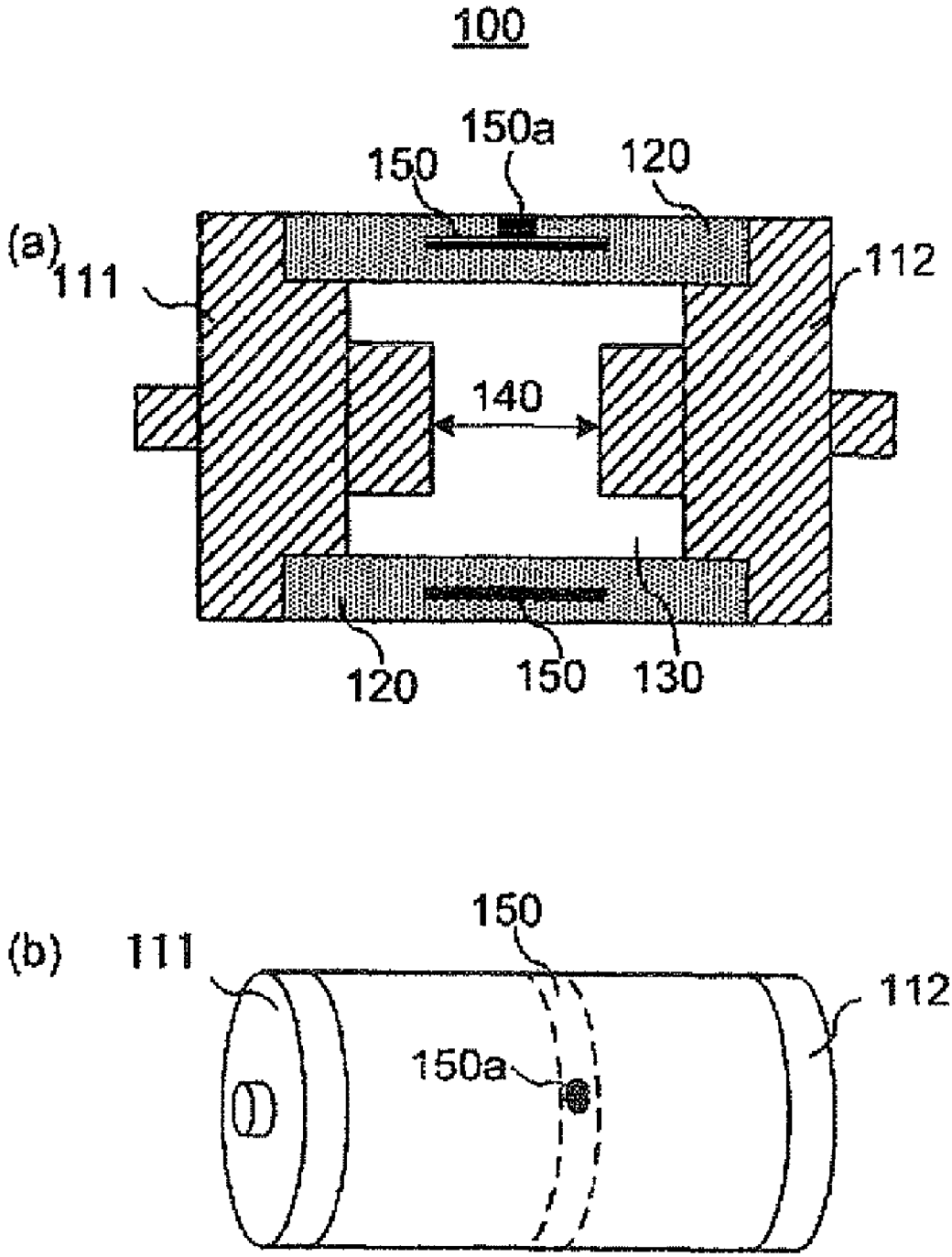

【Figure 5】
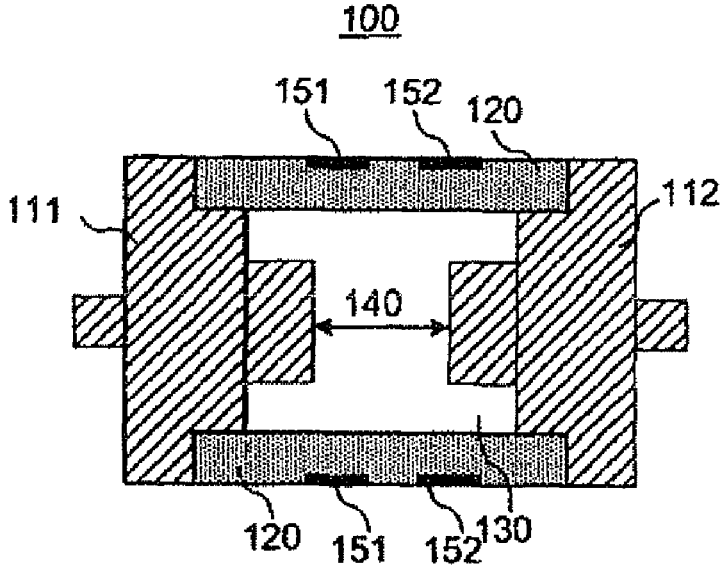
【Figure 6】
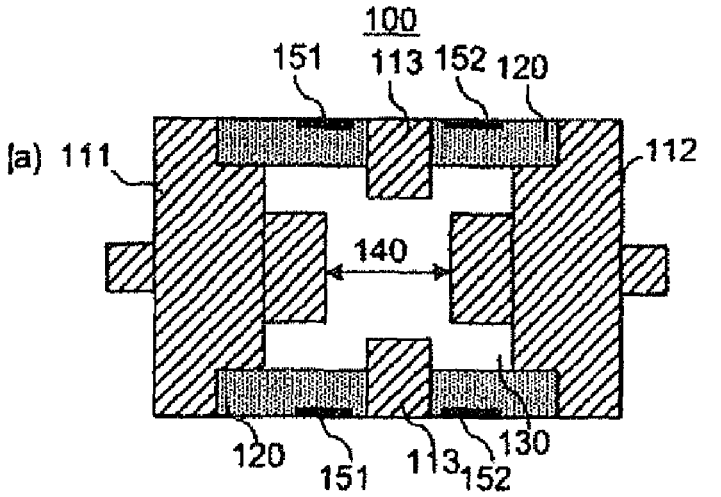
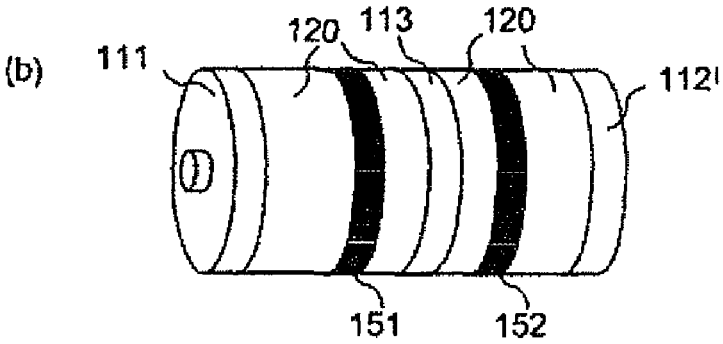

【Figure 7】
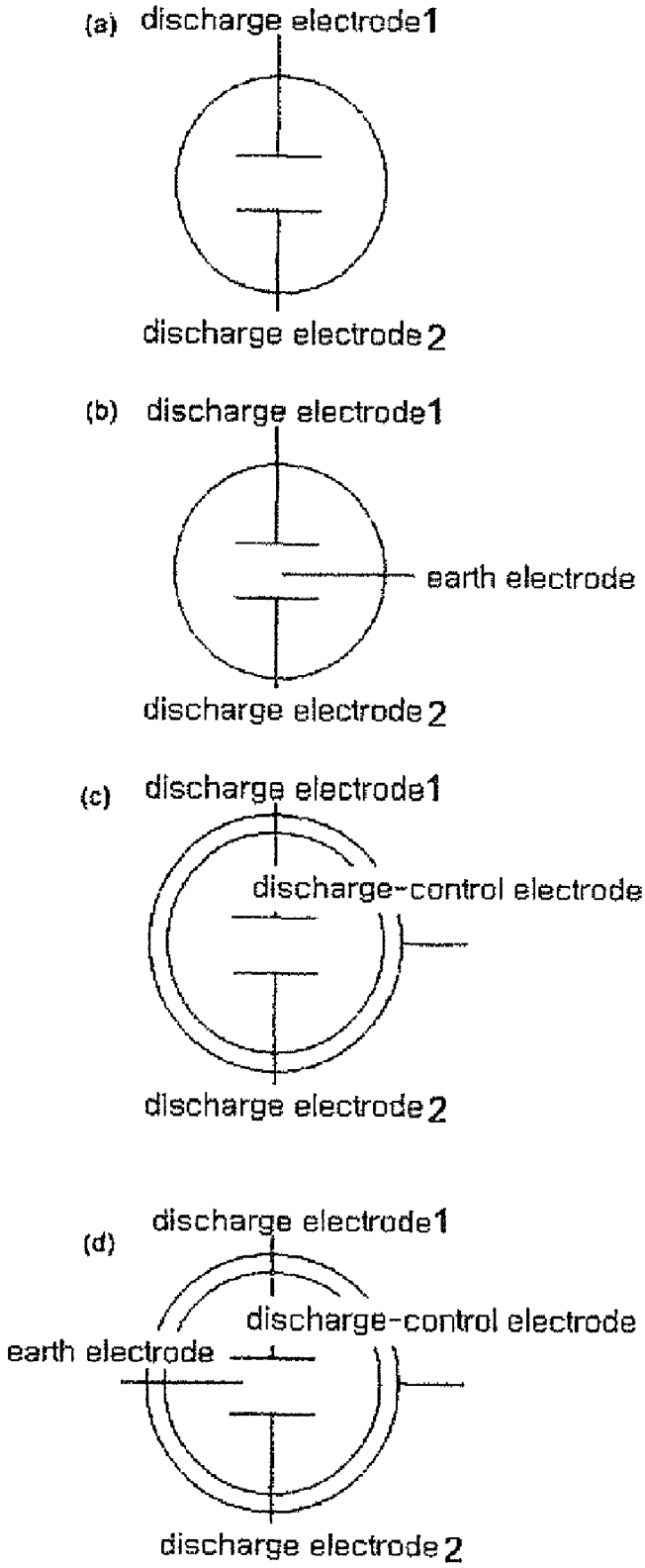

【Figure 8】
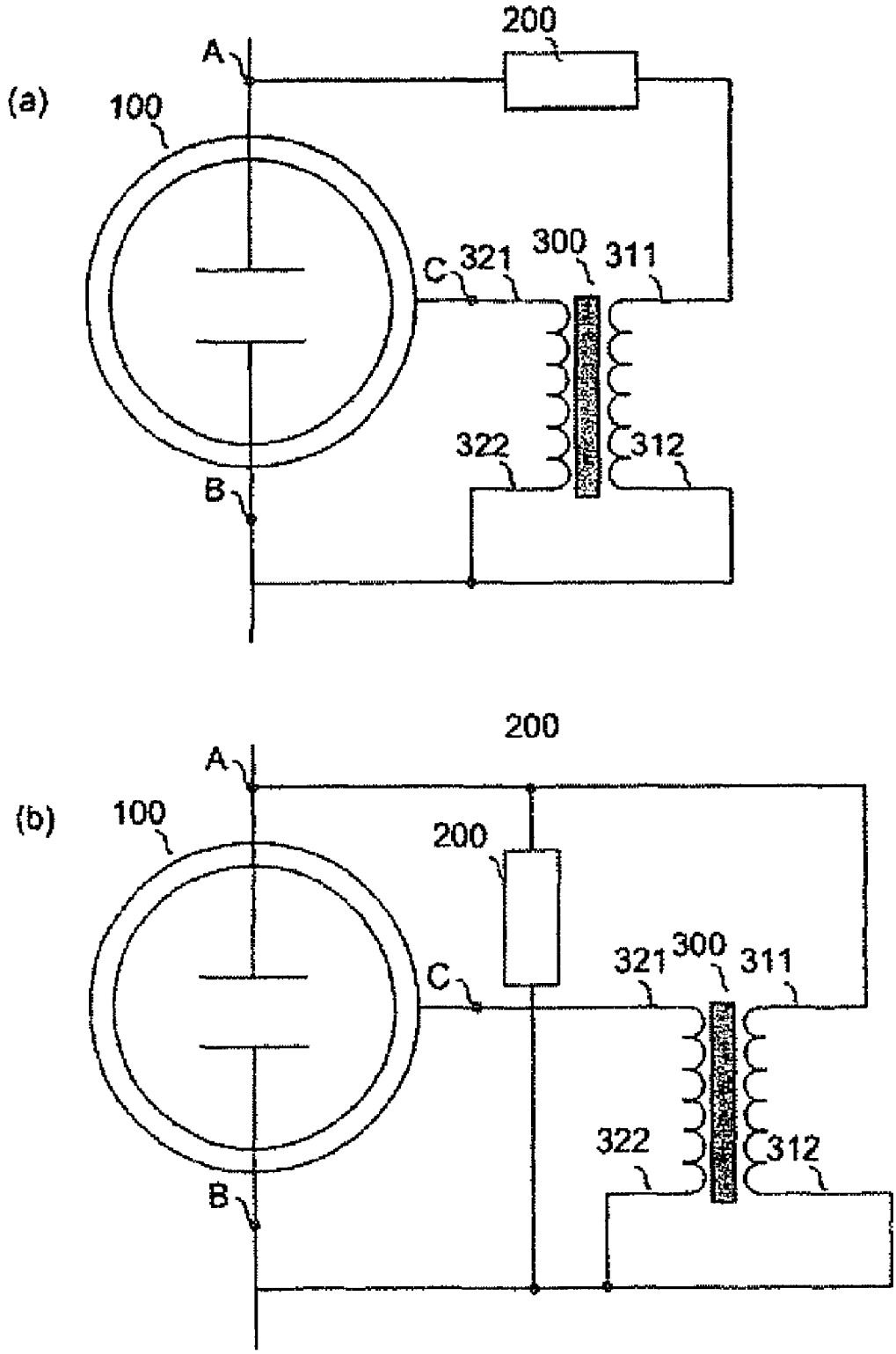

【Figure 9】
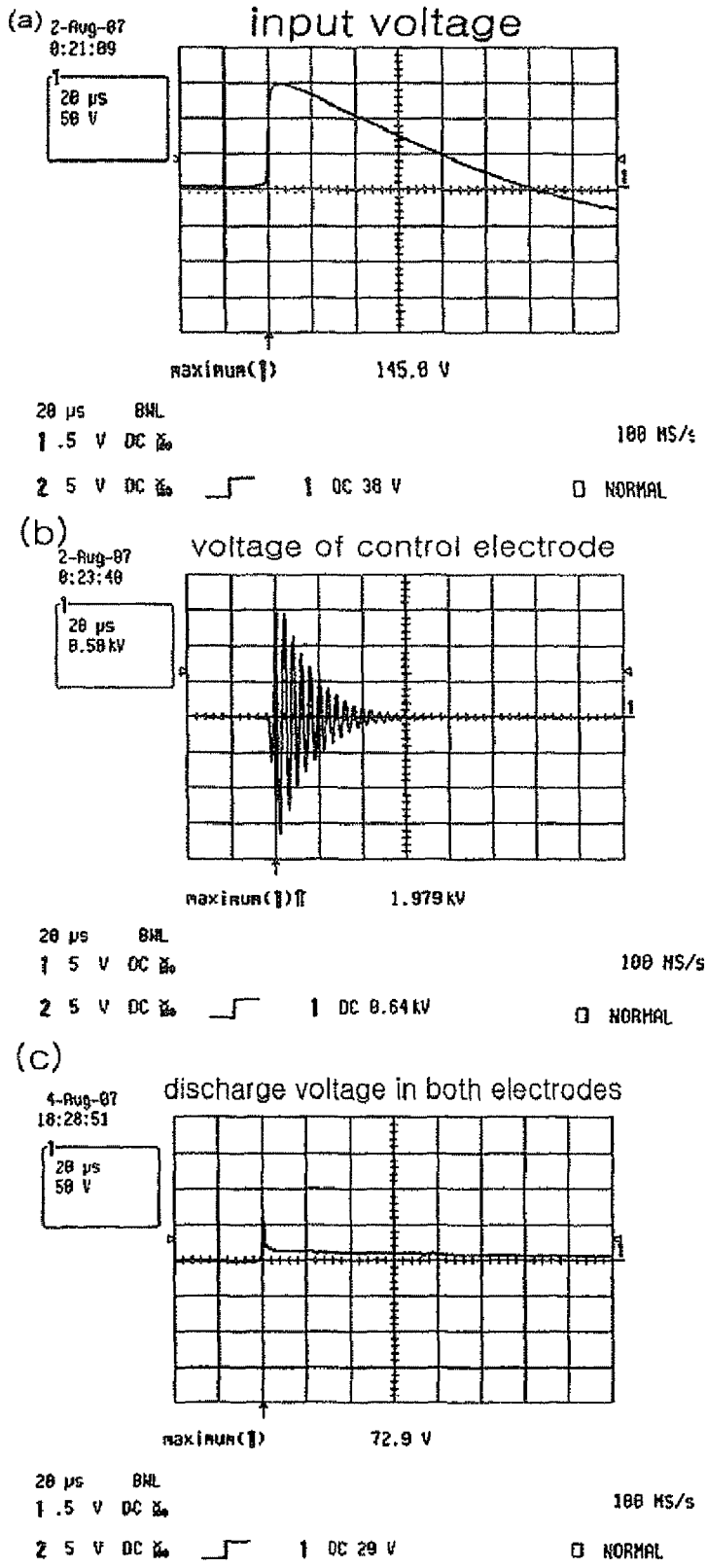

【Figure 10】
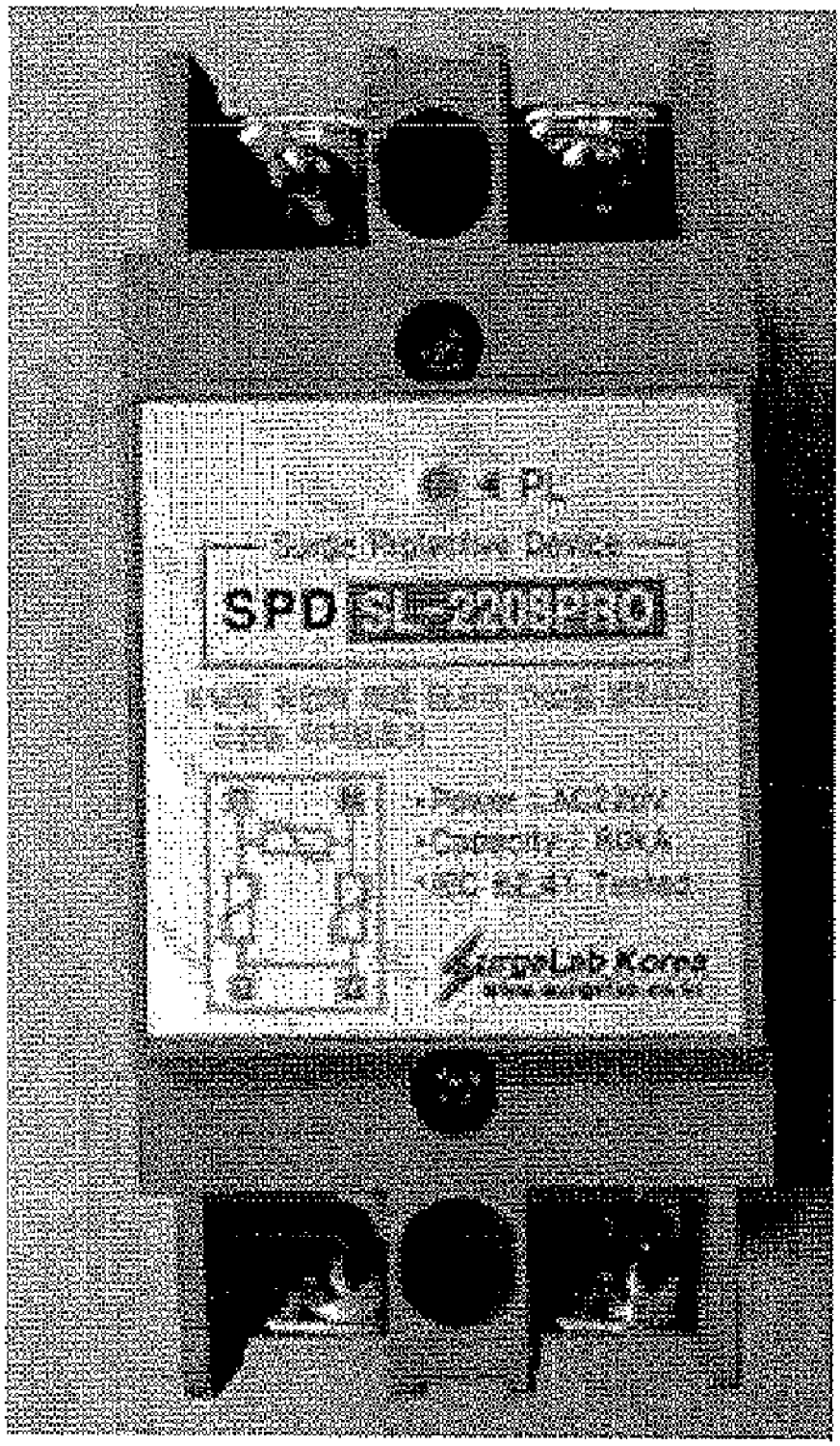

【Figure 11】
power supply: P to N (state that AC220V is applied-surge test)
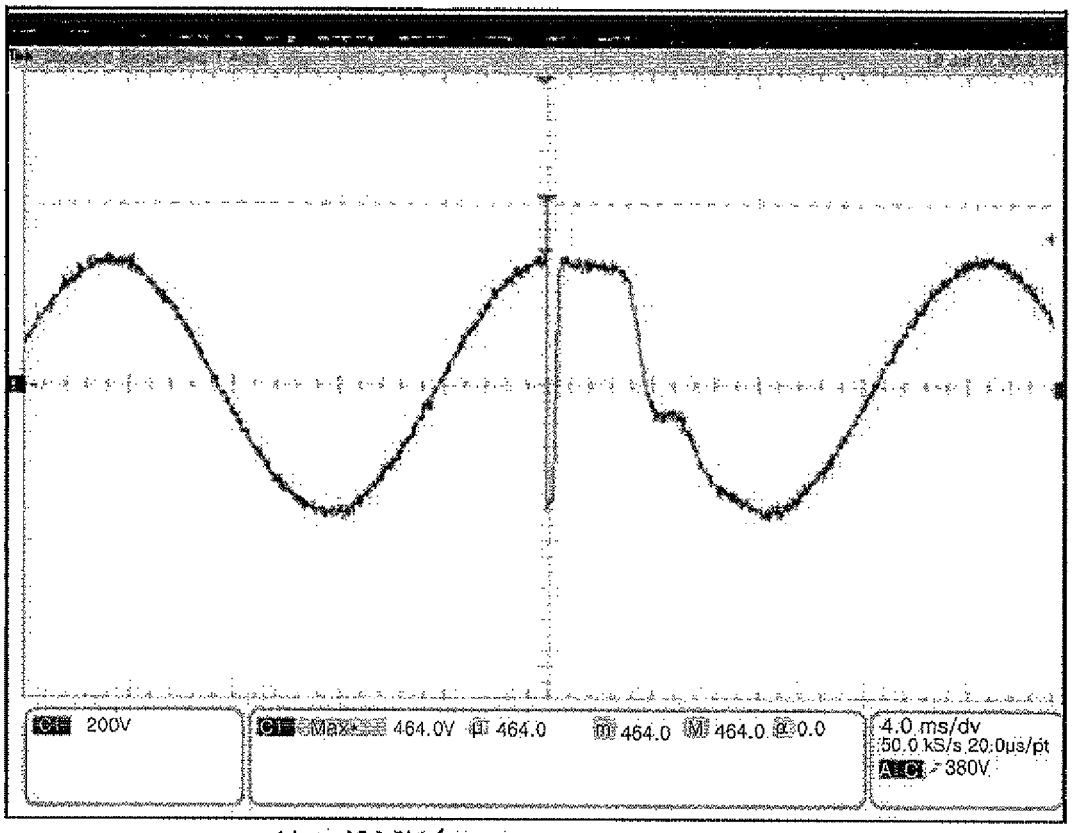
Max 464.0V (surge applied voltage 4kV)

DISCHARGE ELEMENT WITH DISCHARGE-CONTROL ELECTRODE AND THE CONTROL CIRCUIT THEREOF

TECHNICAL FIELD

The present invention relates to a new discharge element having a discharge-control electrode for inducing a discharge even at low voltage by improving a characteristic in which a discharge element may not be discharged against a fast transient voltage when it is at low voltage, and a driving circuit for driving a discharge element according to the present invention.

BACKGROUND ART

FIG. 1 illustrates a 2-pole discharge element in the prior art, and the element includes discharge electrode 1 and discharge electrode 2 at both ends of a cylindrical tube made of a ceramic insulator, and a discharge gap is formed inside the tube, and it has a structure filled with a discharge-assisting material (gas) inside the discharge gap.

In a discharge element as described above, when high voltage is applied between discharge electrode 1 and discharge electrode 2, a discharge-assisting material filled in the discharge gap starts a glow discharge while being ionized, and immediately it is followed by an ark discharge when a discharge current becomes large by the glow discharge, and thus a voltage applied between the discharge electrodes is instantaneously discharged and vanished.

FIG. 2 illustrates a 3-pole discharge element in the prior art, and the element includes earth electrode contacted with discharge-assisting material (gas), discharge electrode 1 and discharge electrode 2 at both ends of a cylindrical tube made of a ceramic insulator, and a discharge gap is formed by discharge electrode 1 and discharge electrode 2, and it has a structure filled with a discharge-assisting material (gas) inside the discharge gap.

In a 3-pole discharge element of FIG. 2, when high voltage is applied between discharge electrode 1–discharge electrode 2, discharge electrode 1–earth electrode, or discharge electrode 2–earth electrode, a discharge-assisting material filled therein starts a glow discharge while being ionized, and immediately it is followed by an ark discharge when a discharge current becomes large by the glow discharge, and thus a high voltage applied between the electrodes is instantaneously discharged and vanished.

As seen in FIGS. 1 and 2, in a conventional discharge element, all of electrodes constituting the discharge element are physically and electrically connected to discharge-assisting material filled therein.

The discharge element is a gas-filled relay tube in which the discharge-assisting material is gas or vacuum, and it has a discharge characteristic that the tube is discharged at a level of about 90 V against direct current or transient voltage having a slow rising speed, such as a level of 100 V/sec. However, when a fast transient voltage, such as a level of 1,000 V/μs, is applied, it has a discharge characteristic that the tube is not discharged at a level of 700 V or lower.

On the basis of the discharge characteristic of a convention discharge element, the recommendation of ITU-T is a different regulation from that of ANSI/IEEE. For a discharge element used as a protection element of PSTN lines, the ITU-T recommends that the element should be discharged at a level of 600V or lower against a slow rising speed, such as 100 V/sec while regulations such as ANSI/IEEE 61000-4-5 and UL497 define a fast transient characteristic of 1.2 μs/50 μs, and therefore those regulations have a problem that cannot be compromised even among such international regulations.

In a state of disorder that even international regulations for such fast applied transient voltages are not unified, it is reality that the discharge element firmly occupies its place as a surge protection element in the communication field.

As an example, a UL-certified discharge element of EPCOS, 3P230-05, is discharged at 225 V for direct current, but is discharged at 850 V as a result of testing a fast transient waveform with IEC C62.41 standard.

Accordingly, for a testing according to international regulations that protection elements based on PSTN should be discharged within 600 V in the ITU-T, discharge elements typically used against a characteristic of transient voltage which is quickly applied, such as an induced surge, are all inadequate, and it is reality that lightning damage cannot be prevented even when a terminal box or MDF protection plug is actually installed in a building.

Although the discharge-type element is universally used as a protection element for general communication in RS-232, 422, 485, or the like as well as in the PSTN field, efforts for reducing residual voltage after discharge have been made by adding a multi-level protection circuit, such as double or triple protection, due to the limit of a discharge characteristic thereof.

DISCLOSURE

Technical Problem

In order to solve the problem, an object of the present invention is to provide a low voltage discharge element having a residual voltage characteristic that can be discharged even at a low transient voltage against a surge having a fast transient voltage characteristic, and a circuit for driving a discharge element of the present invention.

More specifically, there is provided a discharge element that is discharged at 100 V or lower when a fast transient voltage, i.e., IEC 062.41 standard surge waveform (1.2 μs/50 μs) is applied between two discharge electrodes facing to each other, and a circuit for effectively driving a discharge element of the present invention.

Furthermore, another object of the invention is to provide a surge protection device having a discharge element of the present invention.

Technical Solution

A discharge element having a discharge-control electrode according to the present invention comprises an airtight cylinder 120 formed with a ceramic insulation material, a pair of discharge electrodes 111,112 arranged for facing an end opening of the airtight cylinder 120, a discharge gap 140 formed between the pair of discharge electrodes 111,112, a discharge-assisting material 130 filled inside the airtight cylinder 120, and a discharge-control electrode 150 in contact with the airtight cylinder 120 and physically separated from the discharge-assisting material 130, wherein a discharge between the pair of discharge electrodes 111,112 is induced by a control voltage applied through the discharge-control electrode 150.

The discharge-control electrode 150 may be formed with a metal line, metal foil or metal piece, and a metal material of the metal line, metal foil or metal piece and a ceramic insulation material that forms an outside of the airtight cylinder 120 are closely contacted (adhered) in a line or surface, and the discharge-control electrode 150 may be inserted into a ceramic insulation material that forms the airtight cylinder 120 to be drawn out to an outside terminal.

At this time, the discharge-control electrode 150 may be a ring-type, U-type or Y-type metal line, a metal foil, or a metal piece, and furthermore, the discharge-control electrode 150 may be electrically connected with one or more metal lines, metal foils, or metal pieces to be drawn out to a single terminal.

The discharge element may further comprise an earth electrode 113 that a through hole is formed between the discharge gap 140 and the airtight cylinder 120 to be physically contacted with the discharge-assisting material.

A control circuit of a discharge element 100 having a discharge-control electrode comprises a high voltage transformer 300, and a limiting element 200 for limiting current, wherein a terminal A of a pair of discharge electrodes in a discharge element having a discharge-control electrode is connected to a terminal 311 of the primary side of the high voltage transformer 300, and another terminal 312 of the primary side of the high voltage transformer 300 and a terminal 322 of the secondary side of the high voltage transformer 300 are connected to another terminal B of the pair of discharge electrodes, and another terminal 321 of the secondary side of the high voltage transformer 300 is connected to a terminal C of the discharge-control electrode in the discharge element, and the limiting element 200 is provided between a terminal A of the discharge electrode and a terminal 311 of the primary side of the high voltage transformer 300, or the limiting element 200 is provided between a terminal A of the discharge electrode and another terminal B of the discharge electrode.

The limiting element 200 is preferably at least one of elements selected from zener diode, varistor, diode, capacitor, TVS (Transient Voltage Suppressor) and piezoelectric element.

The limiting element 200 is preferably a LC resonant circuit, and this is derived from a self capacitance obtained by an element applicable to the limiting element 200, and a reactance obtained by a high voltage transformer, and it can work very usefully in a high frequency circuit.

The high voltage transformer 300 is preferably a piezoelectric transformer, and the high voltage transformer 300 is preferably boosted 10 through 100 times higher than a voltage applied to the primary side to increase the voltage.

A control circuit of a discharge element 100 having a discharge-control electrode according to the present invention may be used as an element constituting a surge protection device, and provides an excellent discharge performance even against a low voltage applied at high speed, and provides a low residual voltage characteristic, thereby providing a surge protection device having a more excellent surge protection performance.

Advantageous Effects

A discharge element having a discharge-control electrode and a control circuit of the discharge element according to the present invention is a new discharge element and a control circuit totally different from the prior art, which has an excellent discharge performance even at a low voltage applied at high speed, and has a low residual voltage characteristic.

Furthermore, a lightning/surge protector having a discharge element having a discharge-control electrode and a discharge-control element according to the present invention may provide a low residual voltage characteristic that the equipment can sufficiently survive even at an induced surge, thereby perfectly protecting the equipment from lightning, as well as provide an opportunity for preparing for a ground of enabling the unification of various international regulations through providing a discharge element discharged at low voltage.

DESCRIPTION OF DRAWINGS

The above and other objects, features and advantages of the present invention will become apparent from the following description of preferred embodiments given in conjunction with the accompanying drawings, in which:

FIG. 1 is a view illustrating a 2-pole discharge element in the prior art;

FIG. 2 is a view illustrating a 3-pole discharge element in the prior art;

FIG. 3 is an embodiment of a discharge element having a discharge-control electrode according to the present invention;

FIG. 4 is another embodiment of a discharge element having a discharge-control electrode according to the present invention;

FIG. 5 is still another embodiment of a discharge element having a discharge-control electrode according to the present invention;

FIG. 6 is still another embodiment of a discharge element having a discharge-control electrode according to the present invention;

FIG. 7 is a view illustrating a characteristic of a discharge element in the prior art and a discharge element having a discharge-control electrode according to the present invention, and FIG. 7A illustrates a 2-pole discharge element, FIG. 7B illustrates a 3-pole discharge element, FIG. 7C illustrates a 2-pole discharge element having a discharge-control electrode according to the present invention, and FIG. 7D illustrates a 3-pole discharge element having a discharge-control electrode according to the present invention;

FIG. 8 is an embodiment illustrating a driving circuit of a discharge element having a discharge-control electrode according to the present invention;

FIG. 9 is a result of measuring a characteristic of a discharge element and a control circuit thereof according to the present invention, and FIG. 9A is a pulse waveform applied to an input as a standard surge waveform according to IEEE C62.41, which is a mixed waveform of 1.2 μs/50 μs and 8 μs/20 μs, FIG. 9B is a high voltage pulse applied to a discharge-control electrode of a discharge element according to the present invention, and FIG. 9C is a result of discharge characteristic in which a pulse applied to an input is discharged and vanished by operation of a discharge element;

FIG. 10 is an actual manufactured product of a surge protection device having a discharge element and a control circuit thereof according to the present invention; and FIG. 11 is a surge test result measured by using a surge protection device of FIG. 10.

[Detailed Description of Main Elements]

| | |
|---|---|
| 100: discharge element having discharge-control electrode | |
| 111, 112: discharge-control electrode | 120: ceramic insulator |
| 130: discharge-assisting material (gas) | 140: discharge gap |
| 150, 151, 152: discharge-control electrode | 113: earth electrode |
| 200: limiting element | 300: high voltage transformer |

BEST MODE

Hereinafter, a discharge element having a discharge-control electrode and a driving circuit for driving the discharge element according to the present invention will be described in detail with reference to accompanying drawings. The drawings illustrated below are provided as an example to fully convey the thought of the invention to those skilled in the art. Accordingly, the present invention is not limited to the drawings illustrated below, and may be realized by other alternative arrangements. Furthermore, the same reference numerals represent the same structural elements throughout the specification.

Here, unless specifically defined otherwise, all technical or scientific terms used herein have the same meaning as commonly understood by those having ordinary skill in the art to which this invention belongs. In the following description and the attached drawings, the description of well-known functions and constructions which may unnecessarily obscure the gist of the invention will be omitted.

A discharge element having a discharge-control electrode according to the present invention, as illustrated in FIG. 3, includes an airtight cylinder 120 formed with a ceramic insulation material, a pair of discharge electrodes 111,112 arranged for facing an end opening of the airtight cylinder 120, a discharge gap 140 formed between the pair of discharge electrodes 111,112, a discharge-assisting material 130 filled inside the airtight cylinder 120, and a discharge-control electrode 150 in contact with the airtight cylinder 120 and physically separated from the discharge-assisting material 130, wherein a discharge between the pair of discharge electrodes 111,112 is induced by a control voltage applied through the discharge-control electrode 150.

In the embodiment of FIG. 3, there is illustrated an example that a ring-type discharge-control electrode 150 made of a metal foil is formed on an outer surface of the airtight cylinder 120, and the outside of the airtight cylinder 120 formed with the discharge-control electrode 150 is engraved not to form a step profile by the discharge-control electrode 150 on the outer surface, however, the discharge-control electrode 150 according to the present invention may be made by approaching and pressing a U-type or Y-type metal body to the outer surface of the airtight cylinder 120, and may be a winding-type metal body.

The discharge-control electrode 150 may be formed such that it is made of a metal line, metal foil or metal piece, and a metal material of the metal line, metal foil, or metal piece and a ceramic insulation material that forms an outside of the airtight cylinder 120 are contacted in a line or surface. The discharge-control electrode 150, as illustrated in FIG. 4, may be formed such that it is inserted into a ceramic insulation material that forms the airtight cylinder 120 to be drawn out to an outside terminal 150*a*.

Furthermore, as illustrated in FIG. 5, one or more discharge-control electrodes 151,152 are formed, and each of the discharge-control electrodes 151,152 may be electrically connected with to be drawn out to a single terminal.

A thoughtful feature of the invention is to provide a discharge-control electrode that is completely separated and insulated, physically and electrically, when a surge (transient voltage) is not applied to an outside of a discharge gap in which two discharge electrodes are faced to each other, and thus a voltage higher than the voltage applied to a discharge electrode of the discharge-control electrode is created, when a very fast transient voltage is induced, to ionize a discharge-assisting material filled inside the discharge gap, thereby inducing a discharge between the discharge electrodes.

The discharge-assisting material filled inside the discharge gap is preferably air, or a specific vacuum state, and typically a gas filled in the gas-filled relay tube may be used, and according to the characteristic it may be properly selected from gases, which do not belong to the 18th group (Ne, Ar, Kr, Xe, Rn) in the periodic table of elements, to be used.

In addition, though an embodiment of a discharge tube having a discharge-control electrode according to the present invention has been described on the basis of a discharge element having a 2-pole structure as illustrated in FIGS. 3 through 5, a gist of the invention may be applicable to a discharge element having a 3-pole structure as illustrated in FIG. 6.

Furthermore, though the discharge-control electrodes 151, 152 of FIG. 6, as seen in a three-dimensional view of FIG. 6B, are not electrically connected in the discharge element itself, it is not connected to discharge electrodes 111, 112 and an earth electrode 113 and connected with one or more discharge-control electrodes 151,152 using a metal line.

A discharge element having a discharge-control electrode of the invention by a thoughtful feature of the present invention may be represented by FIG. 7C or FIG. 7D. FIG. 7A illustrates a 2-pole discharge element, FIG. 7B illustrates a 3-pole discharge element, FIG. 7C illustrates a 2-pole discharge element having a discharge-control electrode according to the present invention, and FIG. 7D illustrates a 3-pole discharge element having a discharge-control electrode according to the present invention. As illustrated in FIG. 7, this invention is greatly different from a structure of the discharge element in the prior art, in case where a transient voltage is induced, a discharge is induced between the discharge electrodes or between a discharge electrode and an earth electrode through the discharge-control electrode, which is in a state that is electrically insulated from the discharge-assisting material when the transient voltage is not induced.

More specifically, according to the present invention, a discharge-assisting material is filled in an airtight cylinder, and a discharge-control electrode exists on an outside wall body in the airtight cylinder, and an insulation material exists between the discharge-control electrode and the discharge-assisting material filled inside the airtight cylinder.

The gases such as Ne, Ar, Kr, Xe, Rn, which belong to the 18th group in the periodic table of elements, are called as inert or inactive gases, because an atom has its outermost shell fully filled with electrons and has a very low energy level. For example, in case of $NH_3$, which is an active gas, its outermost shell is filled with electrons through a covalent bond, but its energy by the covalent bond is unstable, when compared with the energy of an inert gas, and therefore it is easily broken, relatively, thereby easily causing an electrochemical reaction. Most of active gases excluding the 18th group in the periodic table of elements may cause an electrochemical reaction due to the energy when they are located in an electric field, and it is commonly understood in physical chemistry that an inert gas located in an electric field easily causes an electrochemical reaction due to its energy produced by the electric field. Moreover, it is difficult for an electric field to pass through a metal, but it has a characteristic that passes through a material, such as ceramic contained in the airtight cylinder, without any resistance, and an inert gas in the airtight cylinder is easily activated by a high voltage applied to a discharge-control electrode in an outside of the airtight cylinder, and such a voltage applied to both electrodes starts to produce a weak glow discharge, thereby more activating the gas, and as a result, causing an ark discharge.

Hereinafter, a control circuit for controlling a discharge element having a control electrode according to the present invention will be described in detail.

The discharge element having a discharge-control electrode according to the present invention includes a high voltage transformer 300, and a limiting element 200 for limiting current, wherein a terminal A of a pair of discharge electrodes in a discharge element having a discharge-control electrode is connected to a terminal 311 of the primary side of the high voltage transformer 300, and another terminal 312 of the primary side of the high voltage transformer 300 and a terminal 322 of the secondary side of the high voltage transformer 300 are connected to another terminal B of the pair of discharge electrodes, and another terminal 321 of the secondary side of the high voltage transformer 300 is connected to a terminal C of the discharge-control electrode in the discharge element, and the limiting element 200 is provided between a terminal A of the discharge electrode and a terminal 311 of the primary side of the high voltage transformer 300 (FIG. 8A), or the limiting element 200 is provided between a terminal A of the discharge electrode and another terminal B of the discharge electrode (FIG. 8B).

As illustrated in FIG. 8A, the limiting element 200 is provided between a terminal A of the discharge electrode and a terminal 311 of the primary side of the high voltage transformer 300, and is preferably at least one of elements selected from zener diode, varistor, diode, capacitor, TVS (Transient Voltage Suppressor) and piezoelectric element.

As illustrated in FIG. 8B, the limiting element 200 is provided between a terminal A of the discharge electrode and another terminal B of the discharge electrode, and is preferably a LC resonant circuit.

A core thought of the present invention, on the basis of a voltage induced (applied) to discharge electrodes A, B in a discharge-control electrode C of a discharge element 100 having the discharge-control electrode C, a voltage applied to the discharge electrodes A, B is boosted and applied to the discharge-control electrode C to ionize a discharge-assisting material, thereby inducing a discharge of the discharge electrode even when a low transient voltage is applied at high speed (several μs) between the discharge electrodes A-B.

As illustrated in FIG. 8A, when it is provided by serially connecting with at least one of limiting elements 200 selected from zener diode, varistor, diode, capacitor, and TVS, it has a simple voltage/current limiting function, but when it is provided with a parallel type resonant circuit, a frequency characteristic of all driving circuits including the discharge electrode 100 may be greatly improved. Here, it is conceived that a lightning impulse of IEEE C61.41 is 1.2 μs/50 μs, and observed that a center frequency of lightning surge is about 800 KHz when its frequency spectrum is analyzed, and considered that a ring wave frequency of the same regulation is 100 KHz, and with reference to the frequency spectrum of standard waveforms such as 5 μs/30 μs, and 10 μs/700 μs, it may be applied based on the frequency characteristic in which a control circuit of the invention will be used, but in this description, there is constructed a LC resonant circuit (LC filter) having a characteristic that current can be mostly passed in the vicinity of rising speed (1.2 μs).

The limiting element 200 is preferably constructed with a piezoelectric element such as ceramic resonator. In this case, however, a resonant frequency of the ceramic resonator should be within the range of frequencies of the lightning impulse.

In case of a typical discharge element, when a surge voltage of 100 V having a rising speed of 5 μs is induced between an electrode A and the other electrode B, it cannot be discharged since a very low pulse is instantaneously induced between the discharge electrodes A-B.

In a control circuit of the invention, as illustrated in FIG. 8, current flows through the limiting element 200, and through a terminal 311 of the primary coil in the high voltage transformer 300, and through another terminal 312, and finally to a terminal B of the discharge element.

The secondary coil in the high voltage transformer 300 preferably has the boosting ratio at least greater than 10 times, more preferably, greater than 10 times and less than 100 times. However, the boosting ratio is a determined value in a control circuit of the invention based on the rated voltage and power supply condition in Korea. Most preferably, high voltage transformer 300 should provide a boosted voltage to a discharge-control electrode of the invention in such a manner that does not induce a discharge under a typical power fluctuation, but induce a discharge under a fluctuation, which is caused by an abnormal transient voltage induced, such as an induced surge, and therefore it would be apparent that it should be determined by considering a level of typical fluctuation of power, based on the rated voltage, power supply condition, and service environment for each country.

FIG. 9 is a result of measuring a discharge characteristic of a discharge element based on its induced voltage by using the discharge element having a discharge-control electrode and a control circuit thereof according to the present invention. The input pulse of FIG. 9A means a voltage applied to the primary side of high voltage transformer, and as a pulse waveform applied to an input, which is a standard surge waveform according to IEEE 062.41, there are mixed waveforms such as 1.2 μs/50 μs and 8 μs/20 μs, at that instant a voltage applied to the primary side exceeds 73 V, as seen in FIG. 9B, the secondary voltage exceeds 2,000 V, and an electric field produced by the high voltage (secondary voltage) applied through a discharge-control electrode functions to fully ionize the discharge-assisting material filled in the discharge gap inside the insulation material.

As a result, when the discharge-assisting material inside the discharge gap is ionized, it is instantaneously discharged through the sequence of a corona discharge-ark discharge between electrodes A-B, and therefore the surge pulse applied to both electrodes will be disappeared in an instant, as illustrated in FIG. 9C. The discharge characteristic, as illustrated in FIG. 9C, is a waveform, which is immeasurable by the prior art, and it is seen that the excellence of the present invention has been experimentally proven.

The control circuit according to the present invention is applicable to a 3-pole discharge element by the prior art, thereby driving an earth electrode terminal as a discharge-control electrode.

However, at this time, the discharge-control electrode (earth electrode) is exposed to the discharge-assisting material therein to accelerate a discharge in a direction of contact point 322 for the discharge-control electrode (earth electrode) and the secondary coil in the high voltage transformer, and thus the discharge characteristic may be remarkably decreased by a phenomenon that an ionization of side A and symbol 321 is slowed down.

FIG. 10 is an actual manufactured product of a surge protection device including a discharge element having a discharge-control electrode and a discharge-control circuit thereof according to the present invention, and a surge and voltage overlap test has been performed using a surge protection device of FIG. 10, and as a result, it is seen that the surge protection device is not tripped even when a surge of 4 kV is applied in a state where AC 220 V has been applied, and the maximum voltage has a very low value as 464 V. FIG. 11 is an example of measuring a surge test result of the surge protection device of FIG. 10.

As described above, though a preferred embodiment of the present invention has been described as an example in detail with reference to the accompanying drawing, the present invention will not be limited to the above embodiment, and various modifications and alterations may be made by those having an ordinary skill in the art without departing from the spirit or scope of the invention.

What is claimed is:

1. A discharge element and a control circuit for protection surge, comprising: an airtight cylinder formed with a ceramic insulation material, a pair of discharge electrodes arranged for facing an end opening of the airtight cylinder, a discharge gap formed between the pair of discharge electrodes, a discharge-assisting material filled inside the airtight cylinder, a discharge-control electrode in contact with the airtight cylinder and physically separated from the discharge-assisting material and a control circuit comprising a high voltage transformer, wherein a terminal A of the pair of discharge electrodes in the discharge element having a discharge-control electrode is connected to a terminal of a primary side of the high voltage transformer, and another terminal of the primary side of the high voltage transformer and a terminal of a secondary side of the high voltage transformer is connected to another terminal B of the pair of discharge electrodes, and another terminal of the secondary side of the high voltage transformer is connected to a terminal of the discharge-control electrode in the discharge element, wherein the discharge-control electrode is formed with a metal line, metal foil or metal piece, and a metal material of the metal line, metal foil or metal piece and a ceramic insulation material that forms an outside of the airtight cylinder are closely contacted in a line or surface, and a discharge between the pair of discharge electrodes is induced by a control voltage applied through the discharge-control electrode, wherein the discharge-control electrode is adapted to receive boosted voltage from the high voltage transformer as a result of excessive voltage including surge applied to the discharge electrode.

2. The discharge element having a discharge-control electrode according to claim 1, wherein the discharge-control electrode is inserted into a ceramic insulation material that forms the airtight cylinder and is drawn out to an outside terminal.

3. The discharge element having a discharge-control electrode according to claim 1, wherein the discharge-control electrode is a ring-type, U-type or Y-type metal line, a metal foil, or a metal piece.

4. The discharge element having a discharge-control electrode according to claim 1, wherein the discharge-control electrode is electrically connected to a single terminal with one or more metal lines, metal foils, or metal pieces.

5. The discharge element having a discharge-control electrode according to claim 1, further comprising an earth electrode that is physically contacted with the discharge-assisting material by extending through a through hole formed between the discharge gap and the airtight cylinder.

6. The discharge element having a discharge-control electrode according to claim 1, further comprising a limiting element for limiting current, wherein the limiting element is provided between the terminal A of the discharge electrode and the terminal of the primary side of the high voltage transformer, or the limiting element is provided between the terminal A of the discharge electrode and the terminal B of the discharge electrode.

7. The control circuit of a discharge element having a discharge-control electrode according to claim 6, wherein the limiting element is at least one of elements selected from zener diode, varistor, diode, capacitor, TVS (Transient Voltage Suppressor) and piezoelectric element.

8. The control circuit of a discharge element having a discharge-control electrode according to claim 6, wherein the limiting element is a LC resonant circuit.

9. The control circuit of a discharge element having a discharge-control electrode according to claim 6, wherein the high voltage transformer is a piezoelectric transformer.

10. The control circuit of a discharge element having a discharge-control electrode according to claim 6, wherein the high voltage transformer has a characteristic that a voltage thereof is boosted 10 through 100 times higher than a voltage applied to the primary side to increase the voltage.

* * * * *